US010766730B1

(12) United States Patent
Pratt

(10) Patent No.: US 10,766,730 B1
(45) **Date of Patent: *Sep. 8, 2020**

(54) NON-ENCLOSED TAPE DISPENSING APPARATUS AND SYSTEM

(71) Applicant: Nathan Pratt, Guthrie, OK (US)

(72) Inventor: Nathan Pratt, Guthrie, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/711,687

(22) Filed: Dec. 12, 2019

Related U.S. Application Data

(63) Continuation-in-part of application No. 16/274,615, filed on Feb. 13, 2019, now Pat. No. 10,538,404.

(60) Provisional application No. 62/827,371, filed on Apr. 1, 2019, provisional application No. 62/630,328, filed on Feb. 14, 2018, provisional application No. 62/649,916, filed on Mar. 29, 2018.

(51) Int. Cl.
*B65H 35/07* (2006.01)
*B65H 35/00* (2006.01)
*B65H 16/00* (2006.01)

(52) U.S. Cl.
CPC ..... *B65H 35/0026* (2013.01); *B65H 16/005* (2013.01)

(58) Field of Classification Search
CPC ..... B65H 35/0026; B65H 35/0033
See application file for complete search history.

(56) References Cited

U.S. PATENT DOCUMENTS

| | | | | |
|---|---|---|---|---|
| 4,711,384 | A | 12/1987 | Harris | |
| 5,788,807 | A | 8/1998 | Gratz | |
| 8,230,894 | B2 * | 7/2012 | Huang | B65H 35/0033 156/577 |
| 8,443,862 | B1 | 5/2013 | Manabat | |
| 2004/0060955 | A1 | 4/2004 | Cheng et al. | |
| 2008/0067211 | A1 * | 3/2008 | Steele | B65H 35/0026 225/77 |
| 2009/0302084 | A1 | 12/2009 | Liu | |
| 2010/0193539 | A1 | 8/2010 | Fathi | |
| 2013/0087275 | A1 | 4/2013 | Johnson et al. | |
| 2013/0306697 | A1 | 11/2013 | Lee | |
| 2017/0275126 | A1 | 9/2017 | Sudhir | |
| 2017/0278597 | A1 | 9/2017 | Houser et al. | |

FOREIGN PATENT DOCUMENTS

| | | | | |
|---|---|---|---|---|
| GB | 2201946 | A | 9/1988 | |
| GB | 2461563 | A * | 1/2010 | B65H 35/0026 |
| WO | WO2011057417 | A1 | 5/2011 | |

* cited by examiner

*Primary Examiner* — Mark A Osele
(74) *Attorney, Agent, or Firm* — Phillips Murrah PC; Martin G. Ozinga

(57) ABSTRACT

Invention includes a non-enclosed tape dispensing apparatus and system that is adapted to communicate with spools of tape or spooled material and allow the material to pass through the middle of the apparatus and then to be cut to a desired length by a cutting surface. The apparatus may also be made of different types of material and can be varied in size and shape to communicate with rolls of tape or spooled material of varying widths.

3 Claims, 19 Drawing Sheets

NON-ENCLOSED TAPE DISPENSING APPARATUS AND SYSTEM

CROSS-REFERENCE TO RELATED APPLICATIONS

The present application claims benefit of U.S. Provisional Application Ser. No. 62/827,371 filed on Apr. 1, 2019. The present application is also a continuation-in-part of U.S. patent application Ser. No. 16/274,615 filed on Feb. 13, 2019, currently pending, which claims benefit of U.S. Provisional Application Ser. No. 62/630,328 filed on Feb. 14, 2018, and which also claims benefit of U.S. Provisional Application Ser. No. 62/649,916 filed on Mar. 29, 2018. The entire content of each of the above-referenced applications is hereby expressly incorporated herein by reference.

BACKGROUND OF THE INVENTION

1. Field of the Invention

In general, the present invention relates to a non-enclosed tape dispensing apparatus and system that works in communication with a cylindrical roll of tape or spooled material. In more particular, the present invention generally provides a non-enclosed tape dispensing device generally utilized on a roll of tape or spooled material to allow greater portability, freedom and ease of use when working with different types of tape or material, which provides a mechanical advantage as well as an easier utilization of same.

2. Description of the Prior Art

Adhesive tape and other similar materials are manufactured on rolls or spools. Because of the cylindrical design of the rolls or spools, the tape or other adhesive material may be dispensed by devices that can be attached to the role or spool. Many of these devices are referred to as tape dispensers. Prior to the development of the tape dispenser, standard clear scotch tape was sold as a roll, and had to be carefully peeled from the end and cut with scissors. There are now primarily three types of tape dispensers, handheld dispensers, tabletop dispensers, and automatic commercial dispensers.

Tape dispensers are beneficial for several reasons: first, tape dispensers enable a person to more easily unroll a section of tape from the roll. Second, many tape dispensers enable a person to identify the ending point of the tape. Without a tape dispensing device or some other device, it can be time consuming and cumbersome to identify the end point of the tape and peel it away from the outermost portion of the spool. Third, many tape dispensers enable a person to quickly grasp the end portion of the tape. Finally, many tape dispensers provide cutting teeth which allow a person to quickly tear off a section of tape.

A tape dispenser is an object that holds a roll of tape and has a mechanism at one end to shear the tape. Dispensers vary widely based on the tape they dispense. Most common, clear tape dispensers (like those used in an office or at home) are commonly made of plastic, and may be disposable. Other dispensers are stationary and may have sophisticated features to control tape usage and improve ergonomics.

Many tape dispensers make it easier to identify the end point of the tape, grasp the tape, unroll it and tear it off. The existing tape dispensers are bulky and awkward. Some existing tape dispensers are large and are designed to be placed on a desktop. Tabletop or desk dispensers are frequently used to hold the tape and allow the operator to pull off the desired amount, tear the tape off, and take the tape to the job. Tabletop dispensers are available with electrical assists to dispense and cut pressure-sensitive tape to a predetermined length. They are often used in an industrial setting to increase productivity along manufacturing or assembly lines. They eliminate the need to manually measure and cut each individual piece of tape on high volumes of product or packaging. By automating this process, automatic tape dispensers reduce material waste caused by human error. They also reduce the time needed to cut each piece of tape; therefore, reducing labor costs and increasing productivity.

Others are portable, yet they are still bulky and not user-friendly. A handheld dispenser is a variation of handheld tape dispenser used to apply tape to close boxes, etc. These handheld dispensers are sometimes referred to as a "tape gun." Some dispensers have cutting teeth that are designed to interact with the sticky side of the tape, and some tape dispensers have cutting teeth that are designed to interact with the top side or non-sticky side of the tape.

The vast majority, if not all, of existing tape dispensers are designed to wrap over and around the roll of tape and grasp the cardboard or plastic inner circumference of the roll. In some cases, the tape dispenser fully encloses around the roll of tape, providing 360 degree enclosure around the roll of tape. In other designs, tape dispensing devices partially wrap around the roll of tape, whereby specialized arms compress the side walls of the tape, and further, tab-like protrusions also partially grasp the underside or inner circumference of the roll of tape. Most tape dispensers have cumbersome and awkward, wrap around or snap together designs that consume much space and can potentially confuse end users. Many existing tape dispensers require multiple moving parts, as well as multiple steps of assembly or installation. As a result of these problems with current tape dispenser designs, a need exists for a new kind of tape dispenser that consolidates the following characteristics: small, compact, open frame design that does not fully enclose or unnecessarily wrap around the roll of tape. Most, if not all, tape dispensers are designed to attach to rolls of tape by utilizing some form of spring compression or by utilizing various substantial wraparound designs.

Due to awkward and bulky design of the existing tape dispensers, users often struggle to hold the tape dispenser, unroll the tape and tear the tape while performing other functions. Because of confusion about which side of the tape dispenser is right side up, many users struggle with understanding how to install the device. Some tape dispensers cause the tape to fold over on itself, which results in unnecessary folded, wrinkled and wasted sections of tape. In addition, virtually all existing tape dispensers are designed to substantially wrap around the roll of tape.

A shortcoming of these designs are both their bulk and their inconvenience in portable use. A tabletop dispenser is exactly what it purports to be, intended to be rested on or fixed to a tabletop. This design obviously lacks any portability. "Tape guns," although portable, are significant in size and can be cumbersome to hold and use while trying to simultaneously perform other tasks. There is currently a need for an adaptive device that is portable, small in size, easily usable and affordable. Currently in the prior art, there is no such device which is sufficient. Therefore, a need exists for a small tape dispenser that remains attached to a roll of tape simply by utilizing the adhesive qualities of the tape itself.

The above discussion is not to be considered exhaustive, however, does demonstrate that a need exists for allowing individuals to efficiently and effectively use tape dispensers. The consuming public is looking for solutions to address these needs and there is an obvious need to fill the gap where the prior art has failed. What is needed is an adaptive device to address these shortcomings in the prior art.

SUMMARY OF THE INVENTION

The present invention essentially provides a tape dispenser comprising a frame having a gripping portion, a middle portion with an aperture, a gusseted portion and a cutting portion, which contains a cutting surface and a holster for same. The present invention is designed to partially and minimally cover a small portion of the outer circumference of a roll of tape or other spooled material while a thread of the tape or material passes through the invention as material is unspooled and then to allow the user to easily sever the tape or material at a desired length.

The invention allows the operator greater portability and ease of use while also allowing the operator freedom to hold and carry other tools or perform various tasks or procedures. Invention generally is a non-enclosed tape dispensing apparatus comprising a cutting end, gripping end, top side, bottom side, right side, left side, aperture, tabs, a roller, tape guides, aperture contact surface, cutting surface, gusset and cavity. The invention may include a clip on holster that may be adapted to hang on a user's belt.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction, arrangement of the components, systems, ranges and amounts thereof set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other apparatus, compositions, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved non-enclosed tape dispensing apparatus that may allow greater stability during use and improved stability during use by persons having a lesser degree of dexterity with their fingers and thumbs.

It is a further object of the present invention to provide a new and improved non-enclosed tape dispensing apparatus that may also be customizable in regard to the size and orientation of the tape roll as desired.

It is another object of the present invention to provide a new and improved non-enclosed tape dispensing apparatus that may also be customizable in regard to the width of tape or spooled material to which it attaches.

An even further object of the present invention is to provide a new and improved non-enclosed tape dispensing apparatus that is susceptible to a low cost of manufacture and implementation, and, thus accordingly, is then susceptible to low prices of sale or use to the consuming public thereby making such economically available.

It is an even further object of the present invention to provide a new and improved non-enclosed tape dispensing apparatus that is held to the tape roll or spool material through the adherence of the material itself rather than by any physical force applied by the apparatus.

Still another object of the present invention is to provide a new and improved non-enclosed tape dispensing apparatus, which provides all of the advantages of the prior art, while simultaneously overcoming some of the disadvantages normally associated therewith.

Another object of the present invention is to provide a new and improved non-enclosed tape dispensing apparatus that may provide for direct interaction with a tape roll surface, which secures the apparatus to the tape roll without any physical force from the apparatus to provide greatly improved stability and accuracy and to allow the operator to freely use the other hand that is not holding the apparatus.

It is another object of the present invention to provide a new and improved non enclosed tape dispensing apparatus and system that may be removably attached to a user's belt or other desired point for easy storing and use with just one hand.

These, together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

DETAILED DESCRIPTION

Figure 1:
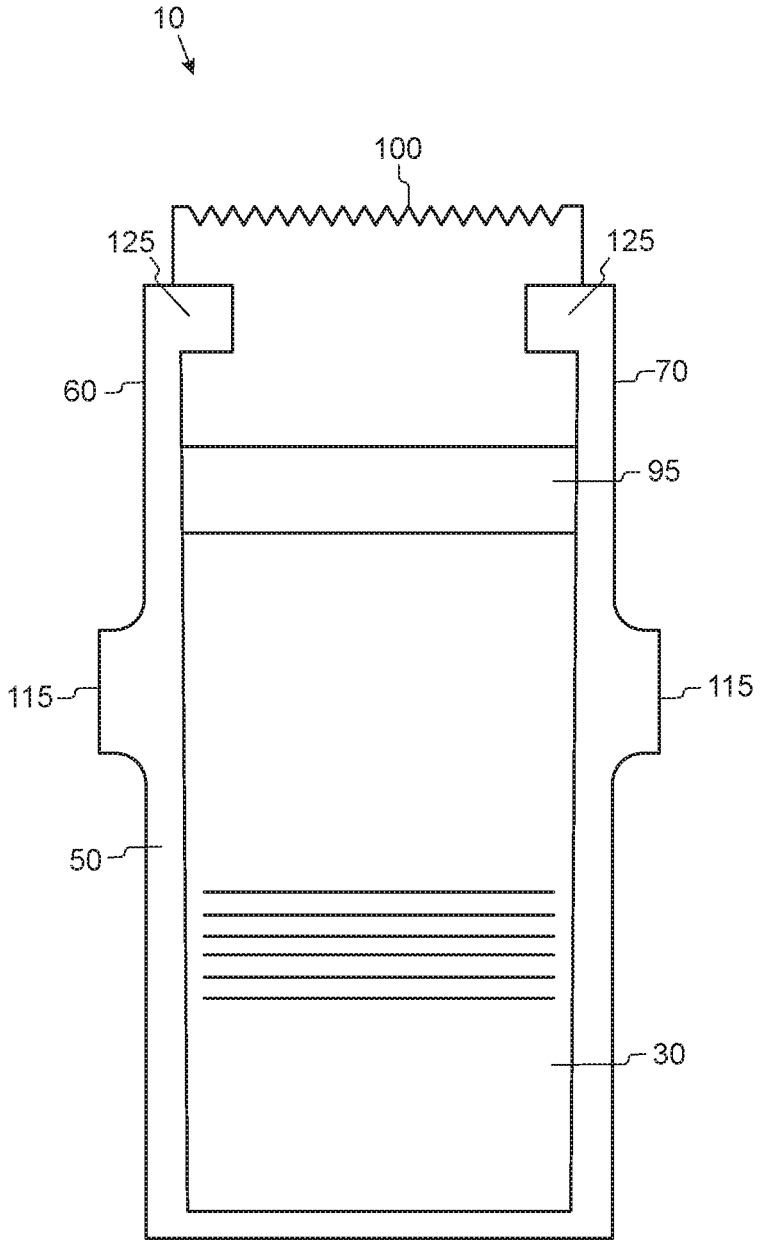
FIG. 1 is generally a bottom view illustration of a preferred embodiment in accordance with the current invention.
Figure 2:
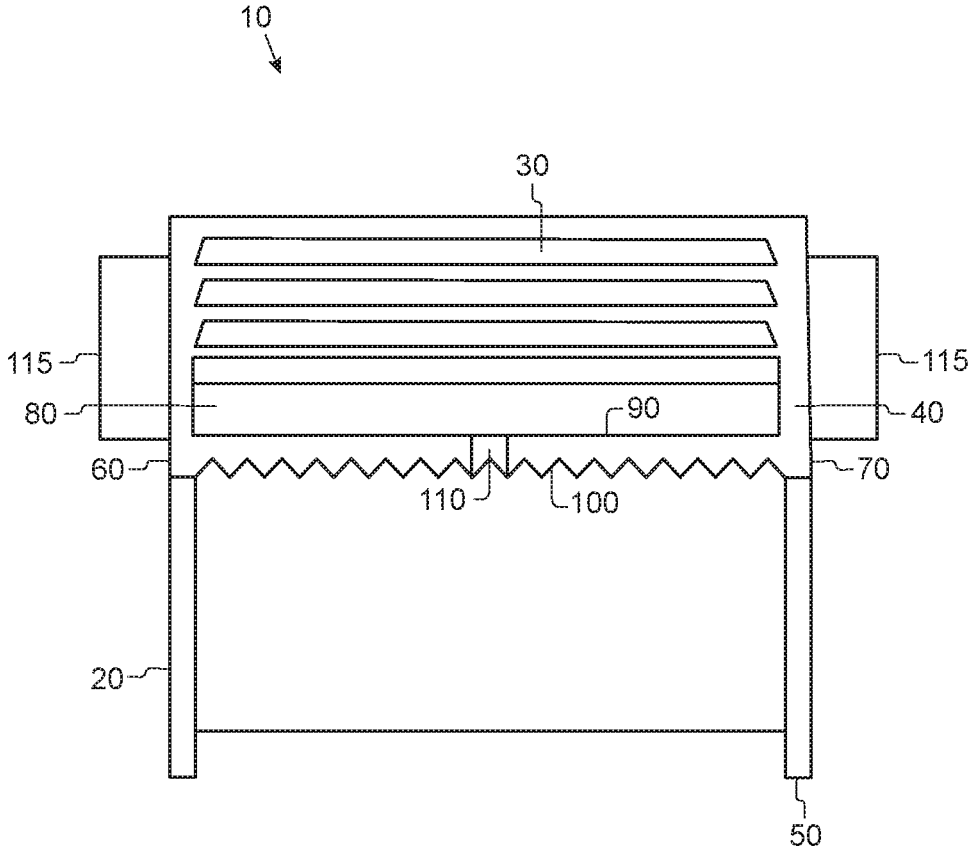
FIG. 2 is generally an end view illustration of a preferred embodiment in accordance with the current invention.

Referring to the illustrations, pictures and drawings, where like elements are generally identified with like numerals throughout, in a preferred embodiment. Invention 10 may be of many dimensions, shapes and sizes and the illustration should not be considered to limit the invention to just the illustrations. It is understood that although the illustrations and detailed description refer to the invention generally as a "non-enclosed tape dispensing apparatus and system," the current invention should not be limited by these terms. It is contemplated that the current invention may have numerous applications and utilities where it is desired to generally provide a non-enclosed tape dispensing apparatus for use on a roll of tape or spooled material. The invention is not limited to tape and may be utilized on other types of materials for other tasks and procedures such as but not limited to spooled material, among other things.

Invention 10 generally includes a cutting end 20, gripping end 30, top side 40, bottom side 50, right side 60, left side 70, aperture 80, aperture contact surface 90, roller 95, cutting surface 100, gusset 110, tabs 115, cavity 120 and tape guides 125. FIGS. 1 through 19 depict preferred embodiments of invention 10. Referring to the above-identified Figures, tape roll or spooled material 130 and a digit and or human hand 140 are shown with the invention applied to tape or spooled material 130 as depicted. It is understood that the invention 10 may be held by user's hand 140. The structure of the invention 10 may be referred to as the body of the invention 10.

The gripping end 30 of the invention 10 is a surface that enables user's digit or hand 140 to rest on the invention 10, as well as enabling the person to press the invention 10 against the outer circumference of the tape or spooled material 130. Gripping end 30 may be textured and may include one or more slits.

The cutting end 20 of the invention 10 may include cutting surface 100. The cutting surface 100 may be constructed at an angle of 0 to 180 degrees relative to the horizontal axis of the invention 10. The cutting surface 100 may be constructed at different lengths and distances from the outer circumference of the roll of tape or spooled material 130 and is adapted to allow the user to easily sever the tape or spooled material 130. It is contemplated, but not intended to be limiting, that the cutting surface 100 may be composed of the same material as the remaining parts of the invention 10 or it may be composed of different materials such as, but not limited to, metal, ceramic, or plastic. It is further contemplated, but not intended to be limiting, that the cutting surface 100 may comprise a serrated edge, cutting teeth, or a sharp edge or other surface designed to sever the tape or spooled material 130. The cutting end 20 and cutting surface 100 may be at angles between 0 and 180 degrees relative to the invention's 10 horizontal axis. Further, the cutting surface 100 and cutting end 20 are adapted so that the user may sever the tape using a downward motion towards the outer circumference of tape 130 or any other motion sufficient to tear the tape 130.

The cutting surface 100 may also include a flat surface that allows for the tape or spooled material 130 to remain attached to the surface after being severed. The portion that abuts the previously described cutting surface 100 is cavity 120 that may include gusset 110. It is understood that invention 10 may have more than one gusset 110.

This cavity 120 is a space over which the tape or material 130 extends where the tape or material 130 makes contact with the cutting surface 100. The gusset 110 is intended to strengthen the cutting end 20 and add an additional contact point for tape or spooled material 130 to adhere when not being actively used. The gusset 110 may also function as a barrier that prevents the tape 130 from getting lodged in the cavity 120. The cavity 120 may be constructed with or without gusset 110. The cavity 120 also allows a user to easily reach under the end point of the tape or spooled material 130 and easily grasp the edge of the tape 130, so that the tape 130 can be pulled through the aperture 80 in order to be severed at the desired length.

The invention 10 may include left side 70 and right side 60 and these surfaces may extend toward the inner most portion of the tape roll or spooled material 130 such that the left side 70 or right side 60 extends beyond the outermost circumference of the tape roll or spooled material 130. It is also contemplated, but not intended to be limiting, that in an embodiment of invention 10 may, or may not, include left side 70 and right side 60 and that either or both of the left side 70 and right side 60 may not extend beyond the outermost circumference of the tape roll or spooled material 130. Left side 70 and or right side 60 may feature sloping surfaces.

The area adjacent to the cutting end 20 may include aperture contact surface 90 adapted to directly communicate with the adhesive side of the tape 130 as a point of contact. Further, the aperture contact surface 90 may be adapted to allow the invention 10 to remain in constant contact with the tape roll or spooled material 130 due to the adhesiveness of the tape 130 without the need of any force from the invention 10. The middle portion of the invention 10 also includes aperture 80 through which the tape or material 130 enters from the roll or spool 130 and exits towards the cutting end 20 and cutting surface 100.

The bottom side 50 of the invention 10 is designed to make direct contact with the outermost circumference of the roll of tape or spooled material 130. This direct communication with the roll of tape or spool of material 130 is contemplated, but not intended to be limited to, to be made by the bottom side 50 of the invention 10 by the gripping end 30, and at the bottom side 50 of the invention 10 at the previously described cutting end 20. These contact points and the constituent parts of the invention 10 may be placed at angles between 0 and 180 degrees relative to the invention's 10 horizontal axis. These contact points allow the invention 10 to comfortably rest on full roll of tape 130, partially used roll of tape 130, or roll of tape 130 that is empty. The bottom side 50 of the invention 10 may be hollow such that the space between the left side 70 and right side 60 is occupied by the roll of tape 130.

The left side 70 and right side 60 may function as constraining members, which guide the invention 10 over the circumference of the tape 130 as it is unspooled through the aperture 80. The left side 70 and right side 60 also prevent the invention 10 from unnecessary side-to-side movement on the tape roll 130, allowing the invention 10 to smoothly track around the circumference of the tape 130. It is contemplated, but not intended to be limiting, that the invention 10 may be self-adjusting through mechanical means to fit snugly on the outer circumference of different widths of tape or spooled material 130.

It is further contemplated, but not intended to be limiting, that the invention 10 may incorporate one or more roller 95. The roller 95 remains in contact with the tape or spooled material 130 as it is unrolled from the roll or spool and after the material has been severed to the desired length. Roller 95 may be, but is not required to be, cylindrically shaped or it may contain a grooved surface and said roller 95 rotates around an axle in contact with the tape or spooled material 130 as the tape or spooled material 130 is being pulled through the invention 10. It is further contemplated, but not intended to be limiting, that roller 95 may be placed on invention 10 at various locations to allow the tape or spooled material 130 to more easily be pulled through the invention 10 in order to sever it at the desired length.

Roller 95 may have protrusions for snapping into body. It is also understood that roller 95 may have a similar function to the aperture contact surface 90. It is also contemplated that aperture contact surface 90 may remain in a fixed position or it may be a dynamic rolling member. It is also understood that invention 10 may not include any rollers.

It is additionally contemplated, but not intended to be limiting, that the invention 10 may incorporate tabs 115. The tabs 115 are protrusions on each side of the invention 10 and increase the functionality of the invention 10 by, among other things, increasing the stability of the invention 10 during use. It is further contemplated, but not intended to be limiting, that invention 10 may also include tape guides 125. The tape guides 125 are in constant contact with the tape or spooled material 130 during use of the invention 10 and keep the invention 10 at the desired location on the tape or spooled material 130 in relation to the cutting end 20 and cutting surface 100.

The invention 10 may be constructed from various materials such as metal, ceramic, plastic, wire, sheet metal, injection molded plastic, 3-D printed material, carbon fiber, wood or other synthetic or natural materials, but is not limited to these materials. The invention may be manufactured by various processes such as injection molding with plastic, metal bending, stamping or other casting and mold making or 3-D printing processes.

In a preferred embodiment, the invention 10 is constructed of metal, ceramic, or plastic. Further, the invention 10 is constructed in such a way as to be close-fitting around a specific width of tape or spooled materials 130, with different sized non-enclosed tape dispensing apparatuses to communicate with tapes of different width. Further, the invention 10 can communicate with tape rolls or spooled material 130 of any circumference or depth. It is contemplated, but not intended to be limiting, that the aperture 80 in the invention 10 is square or rectangular in shape and is fully-enclosed or partially enclosed by left side 70 and right side 60 of the invention 10.

It is contemplated that the material of which the invention 10 is composed is of sufficient structural integrity to undergo rigorous use on tapes and spooled materials 130 of various tensile strength. It is further contemplated that the material of which invention 10 may be composed of will have sufficient malleability to sufficiently withstand the force of shearing the tape or spooled material 130 without stressing to the point of cracking, breaking or otherwise compromising its structural integrity.

Figure 3:
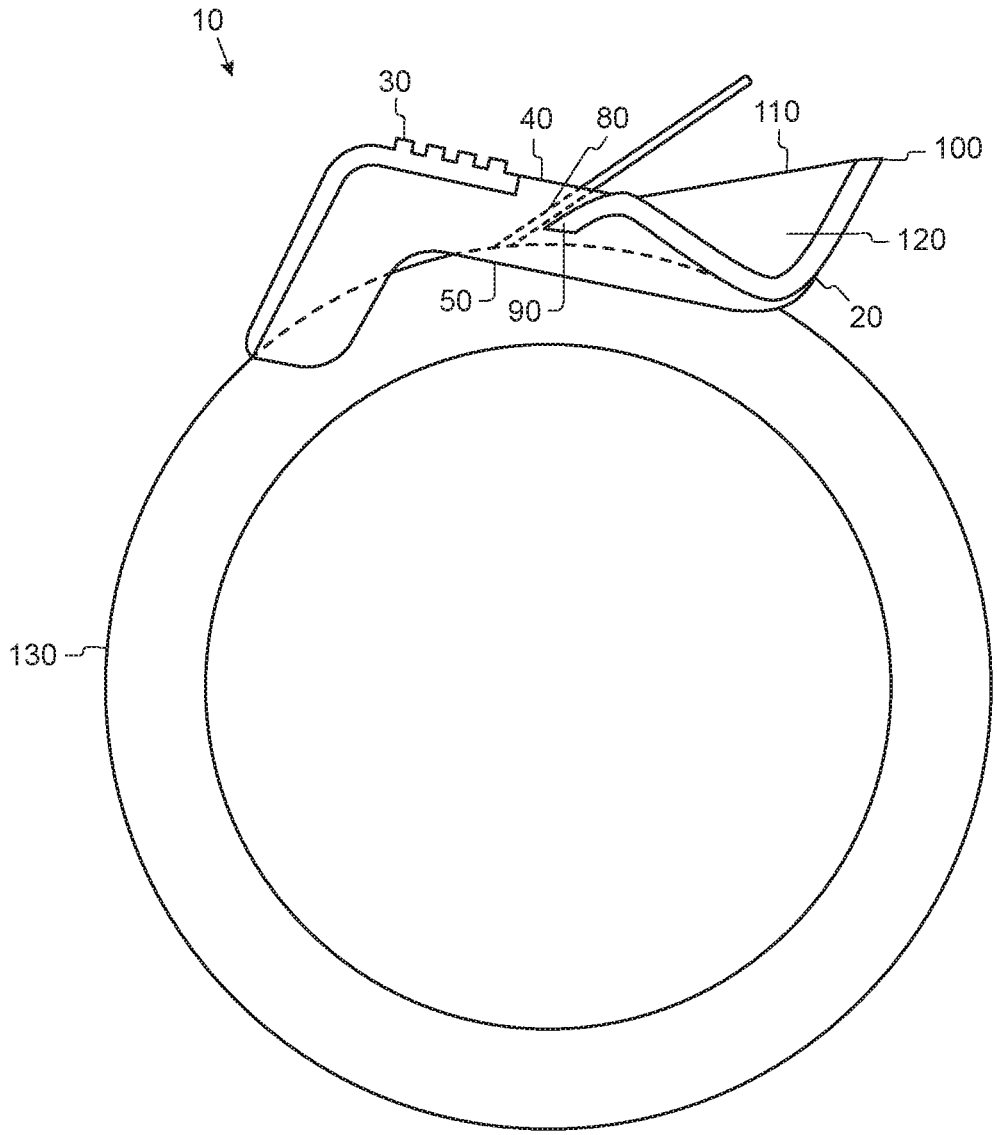
FIG. 3 is generally a side view illustration of a preferred embodiment in accordance with the current invention.
Figure 4:
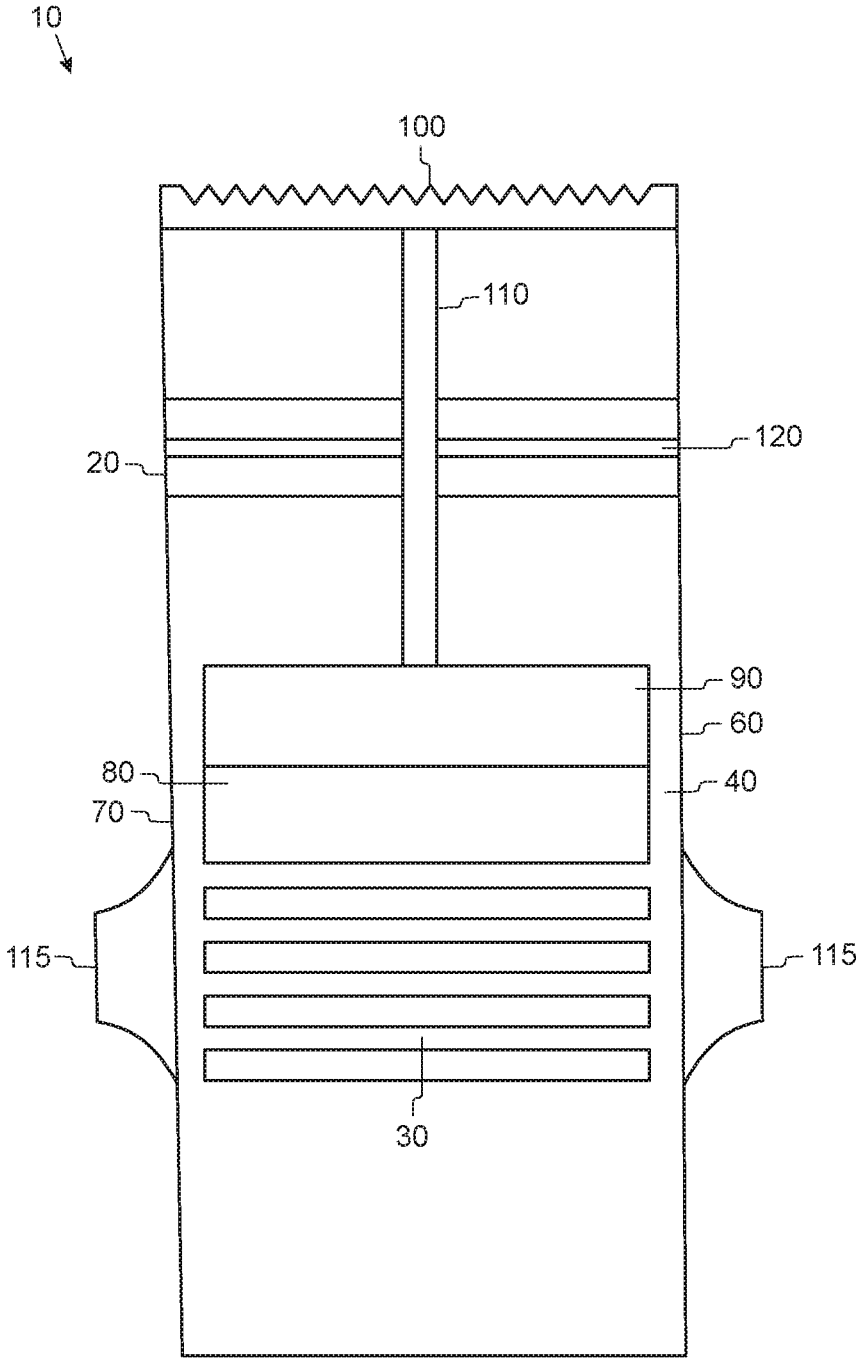
FIG. 4 is generally a top view illustration of a preferred embodiment in accordance with the current invention.
Figure 5:
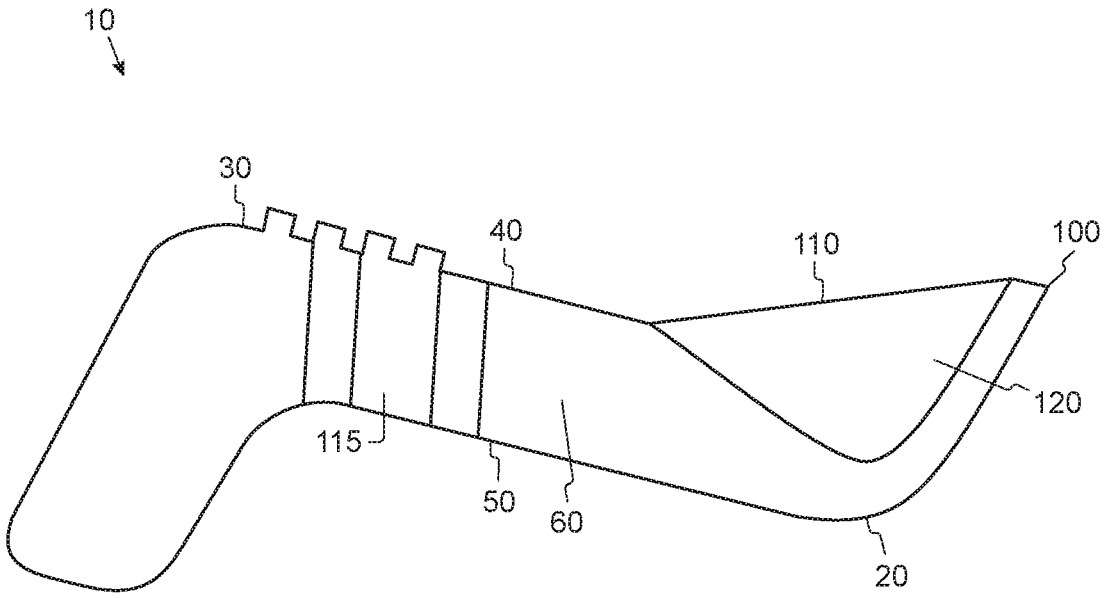
FIG. 5 is generally a side view illustration of a preferred embodiment in accordance with the current invention.
Figure 6:
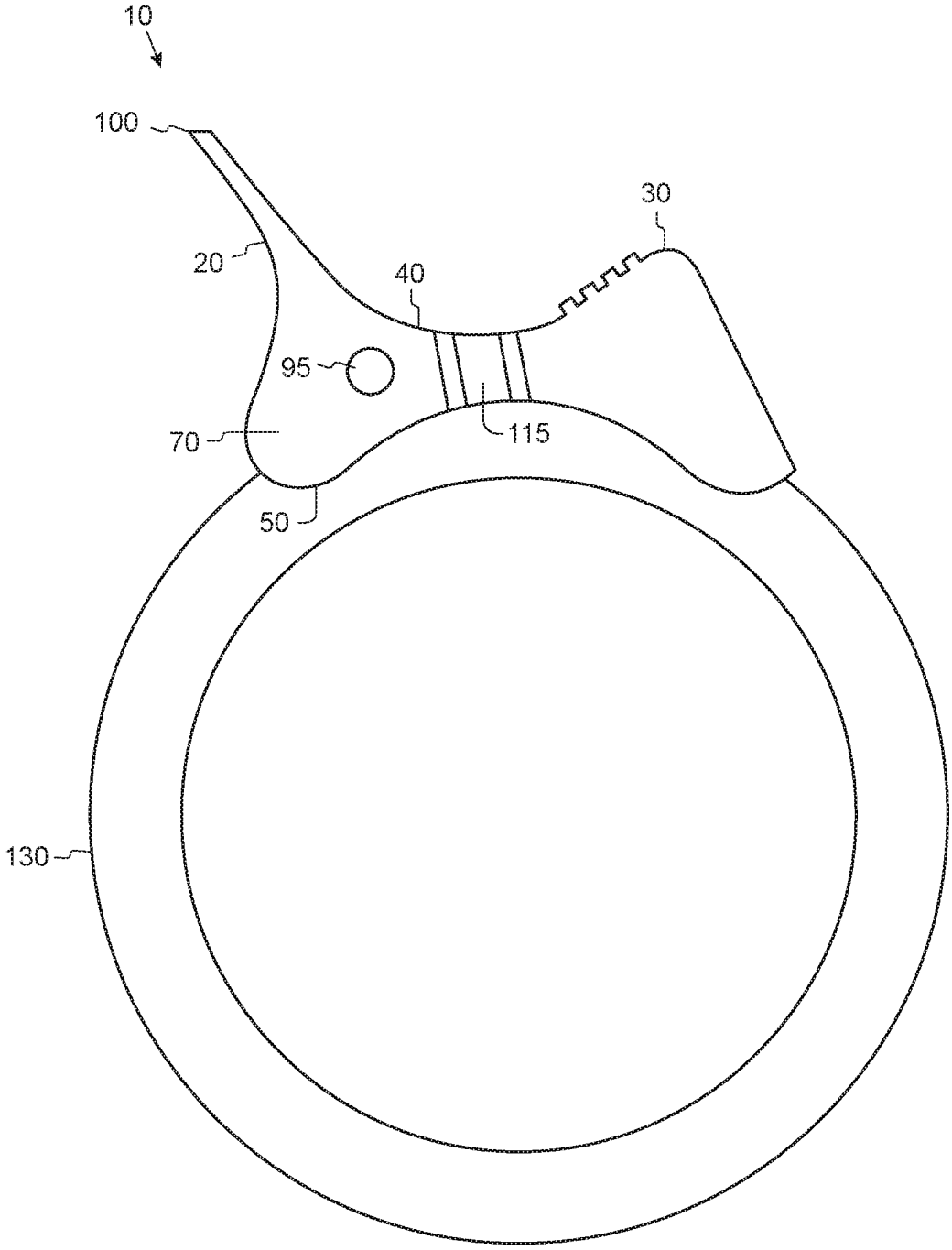
FIG. 6 is generally a side view illustration of a preferred embodiment in communication with a roll of tape in accordance with the current invention.
Figure 7:
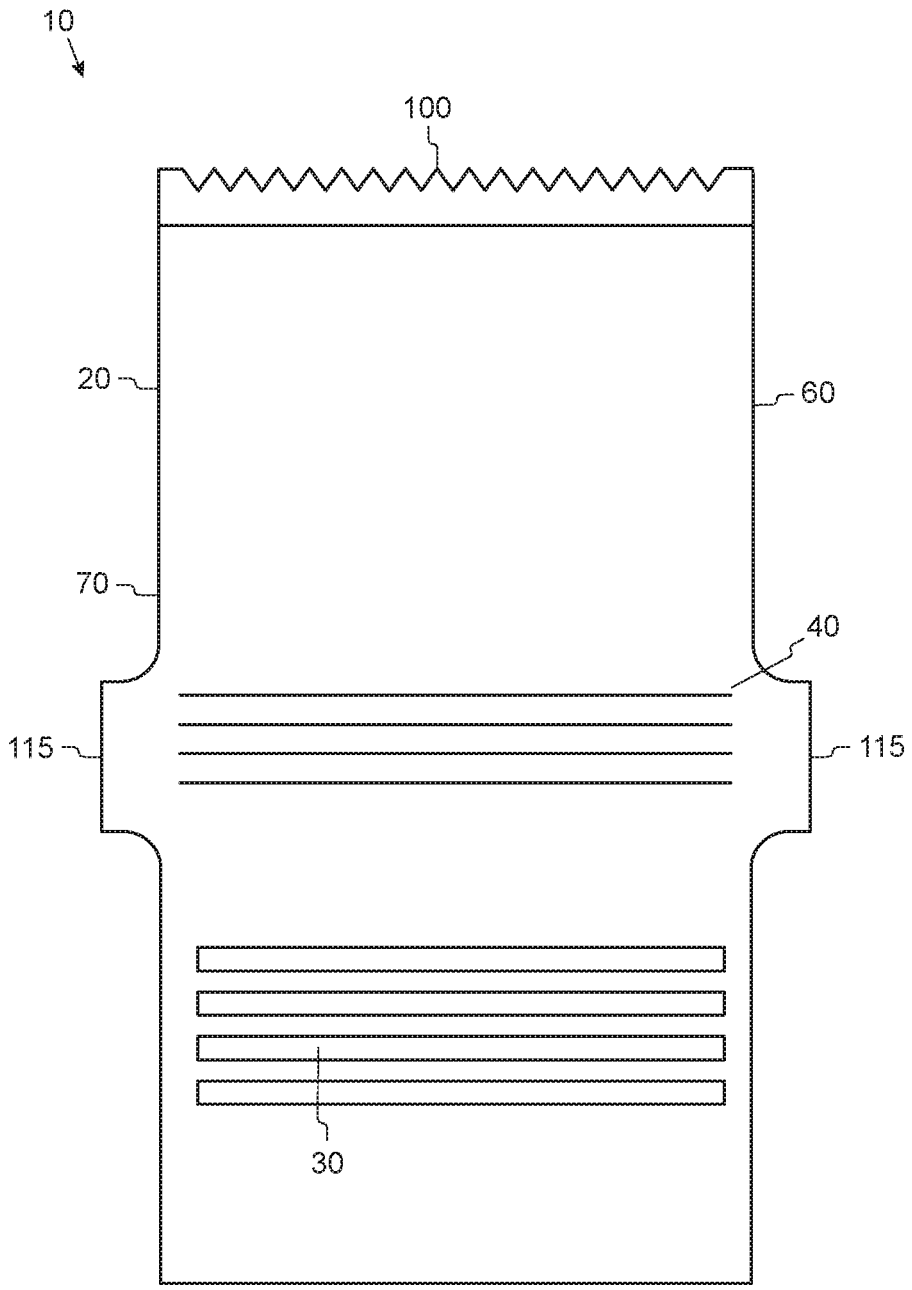
FIG. 7 is generally a top view illustration of a preferred embodiment in accordance with the current invention.
Figure 8:
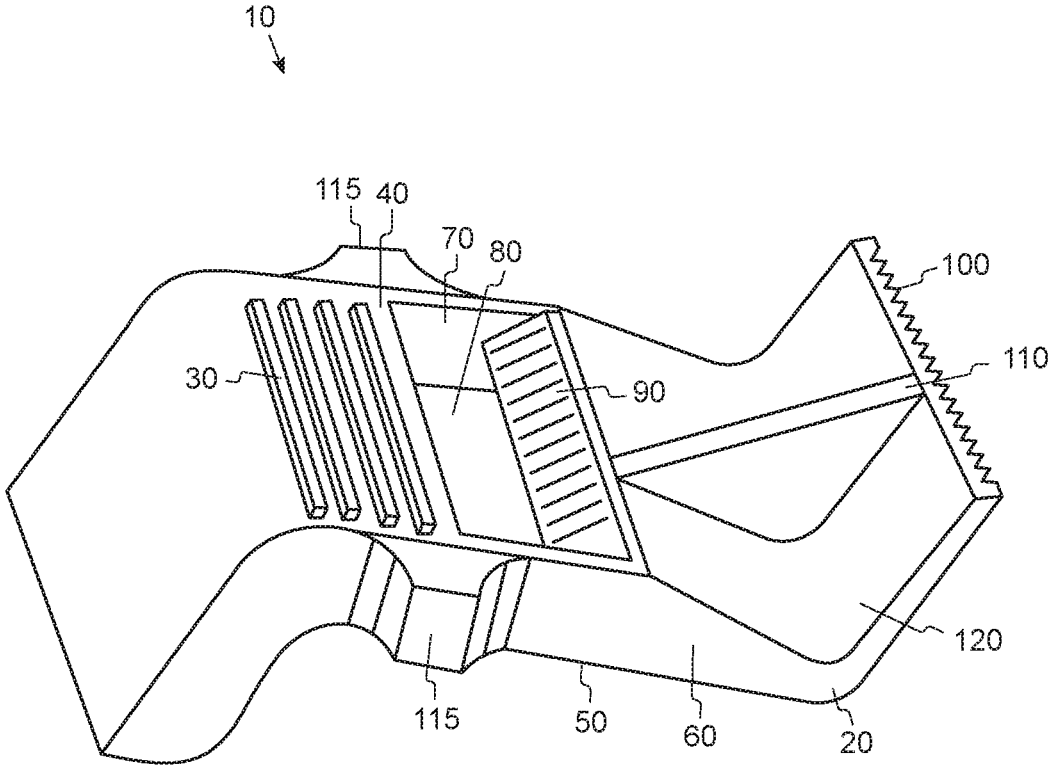
FIG. 8 is generally a dynamic view illustration of a preferred embodiment in communication with a roll of tape in accordance with the current invention.
Figure 9:
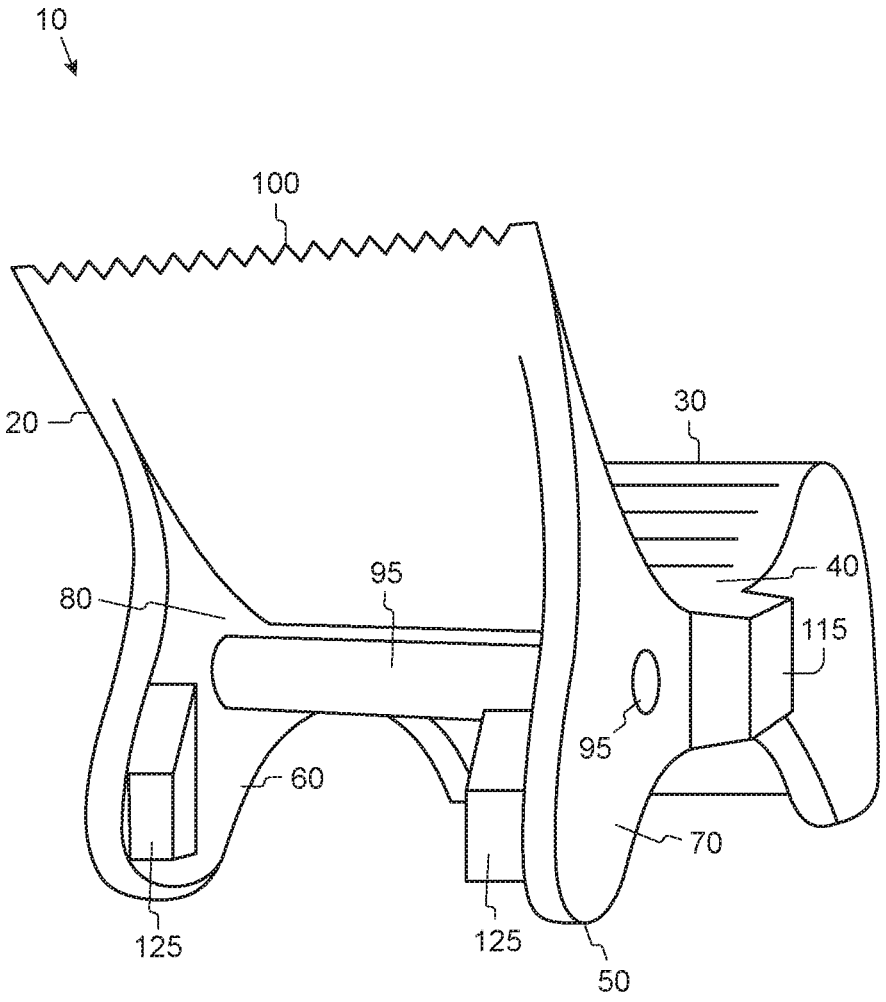
FIG. 9 is generally a dynamic view illustration of a preferred embodiment in accordance with the current invention.
Figure 10:
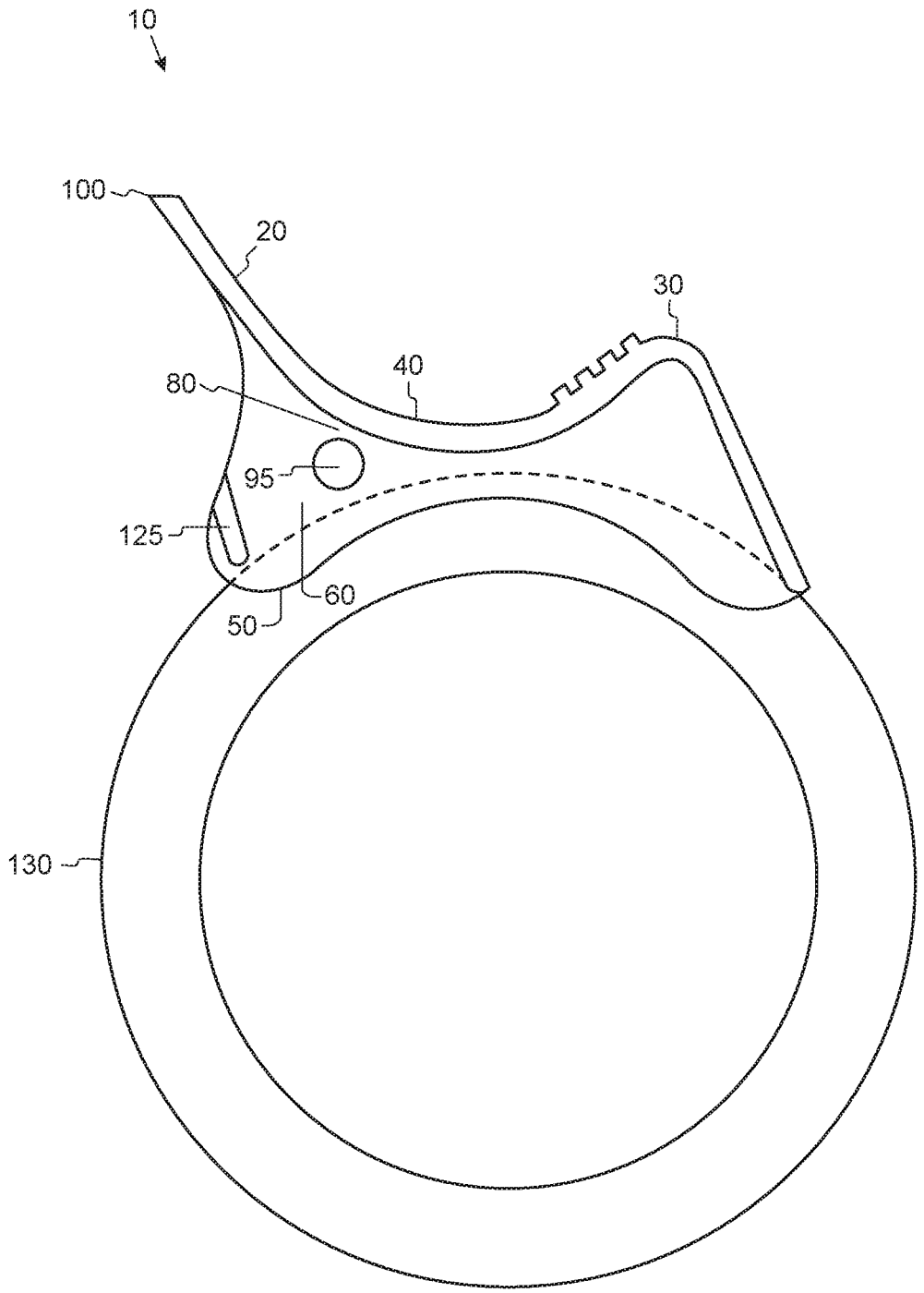
FIG. 10 is generally a side view illustration of a preferred embodiment in communication with a roll of tape in accordance with the current invention.
Figure 11:
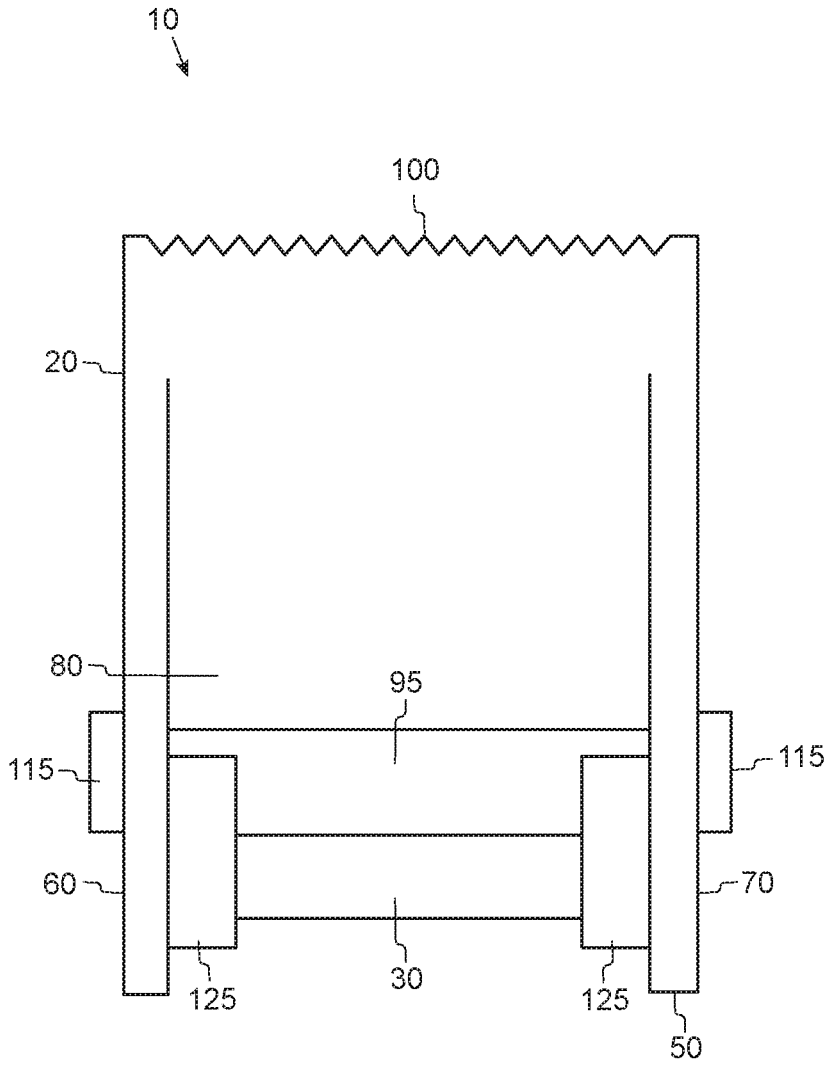
FIG. 11 is generally an end view illustration of a preferred embodiment in accordance with the current invention.
Figure 12:
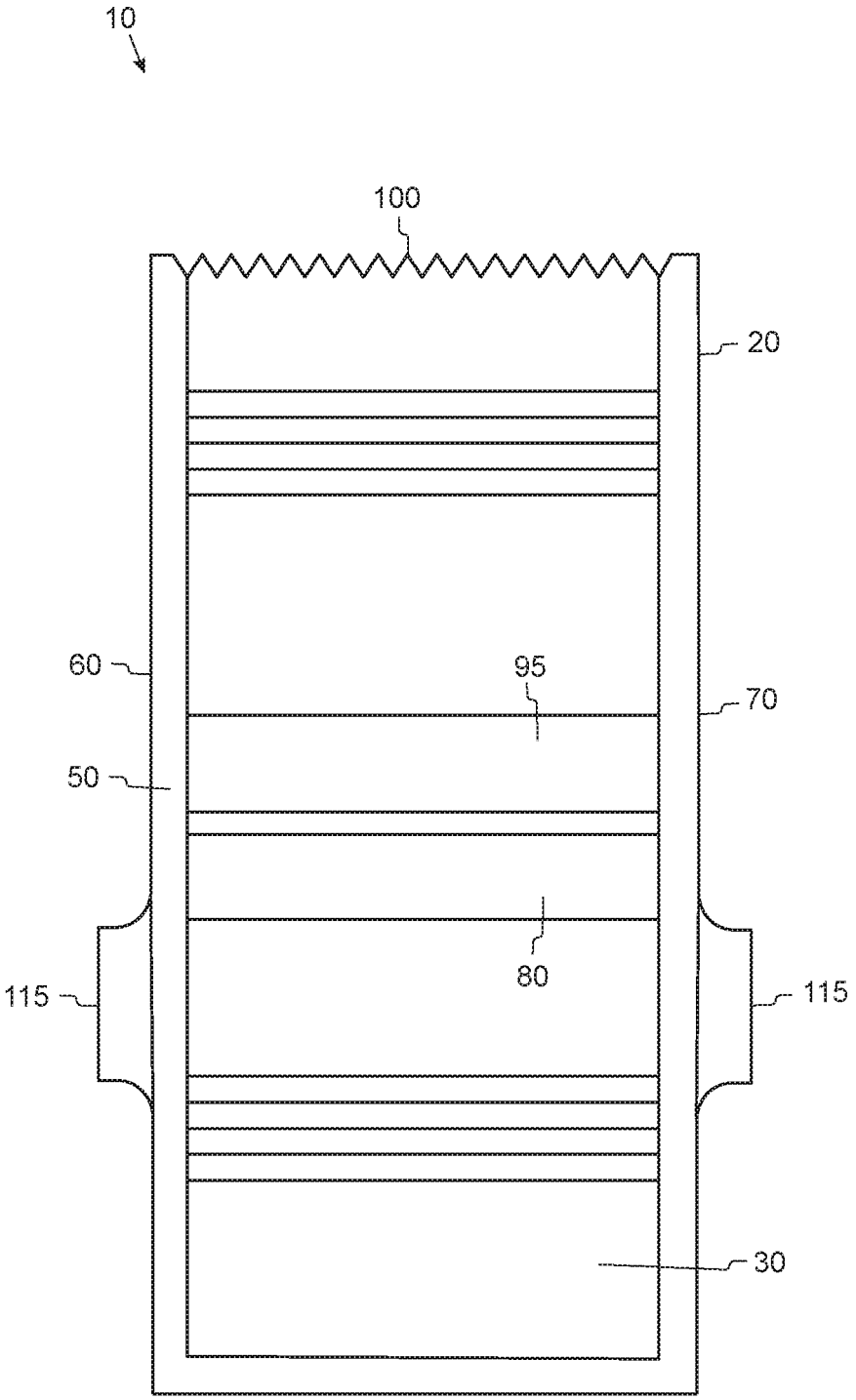
FIG. 12 is generally a bottom view illustration of a preferred embodiment in accordance with the current invention.
Figure 13:
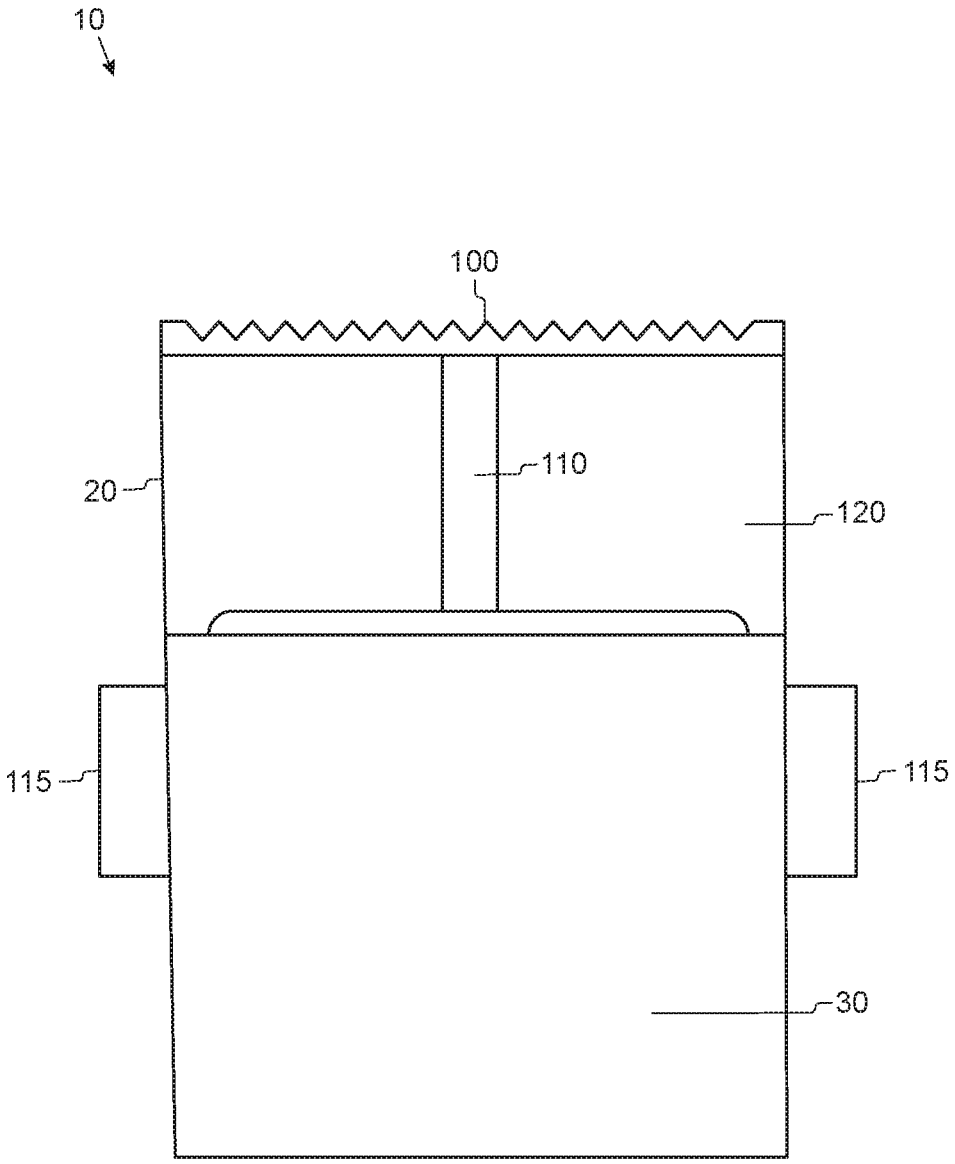
FIG. 13 is generally an end view illustration of a preferred embodiment in communication with a roll of tape in accordance with the current invention.
Figure 14:
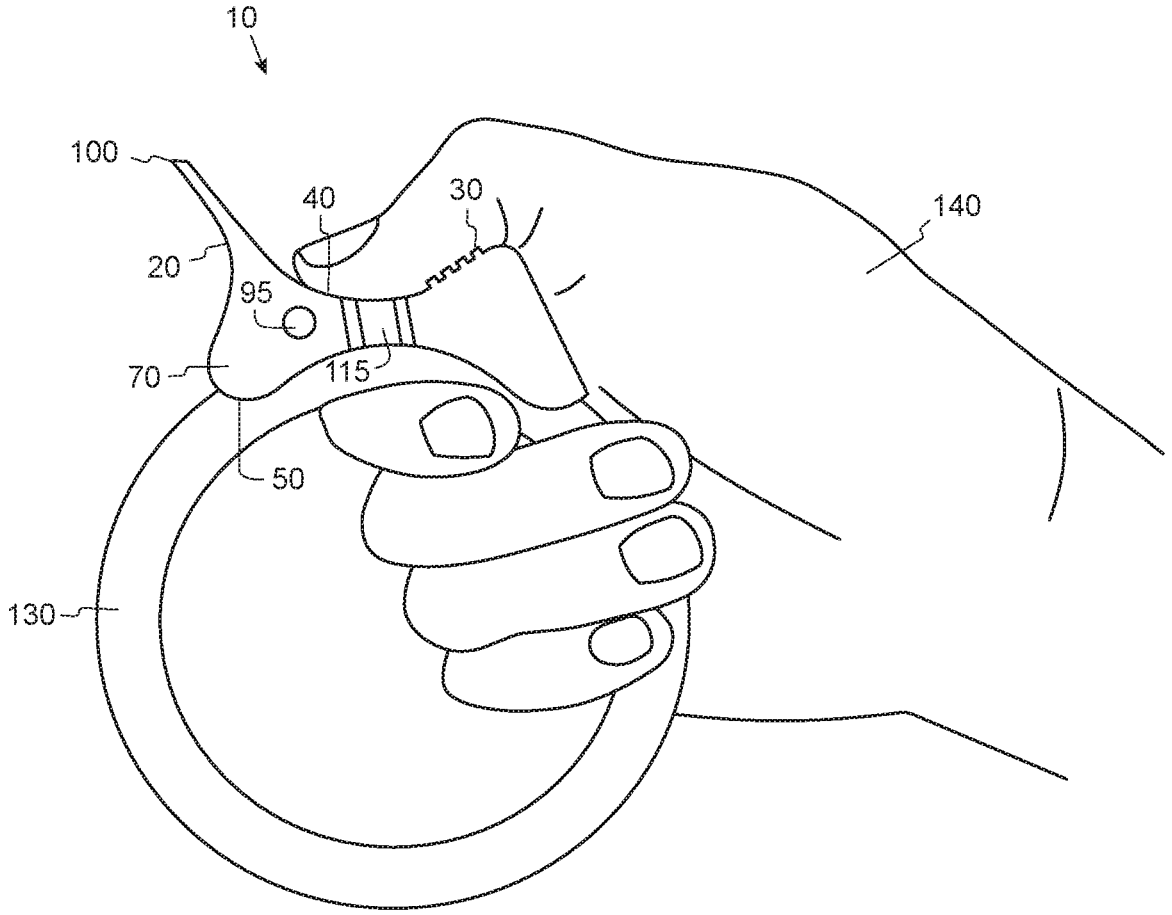
FIG. 14 is generally a side view illustration of a preferred embodiment in communication with a roll of tape in accordance with the current invention.
Figure 15:
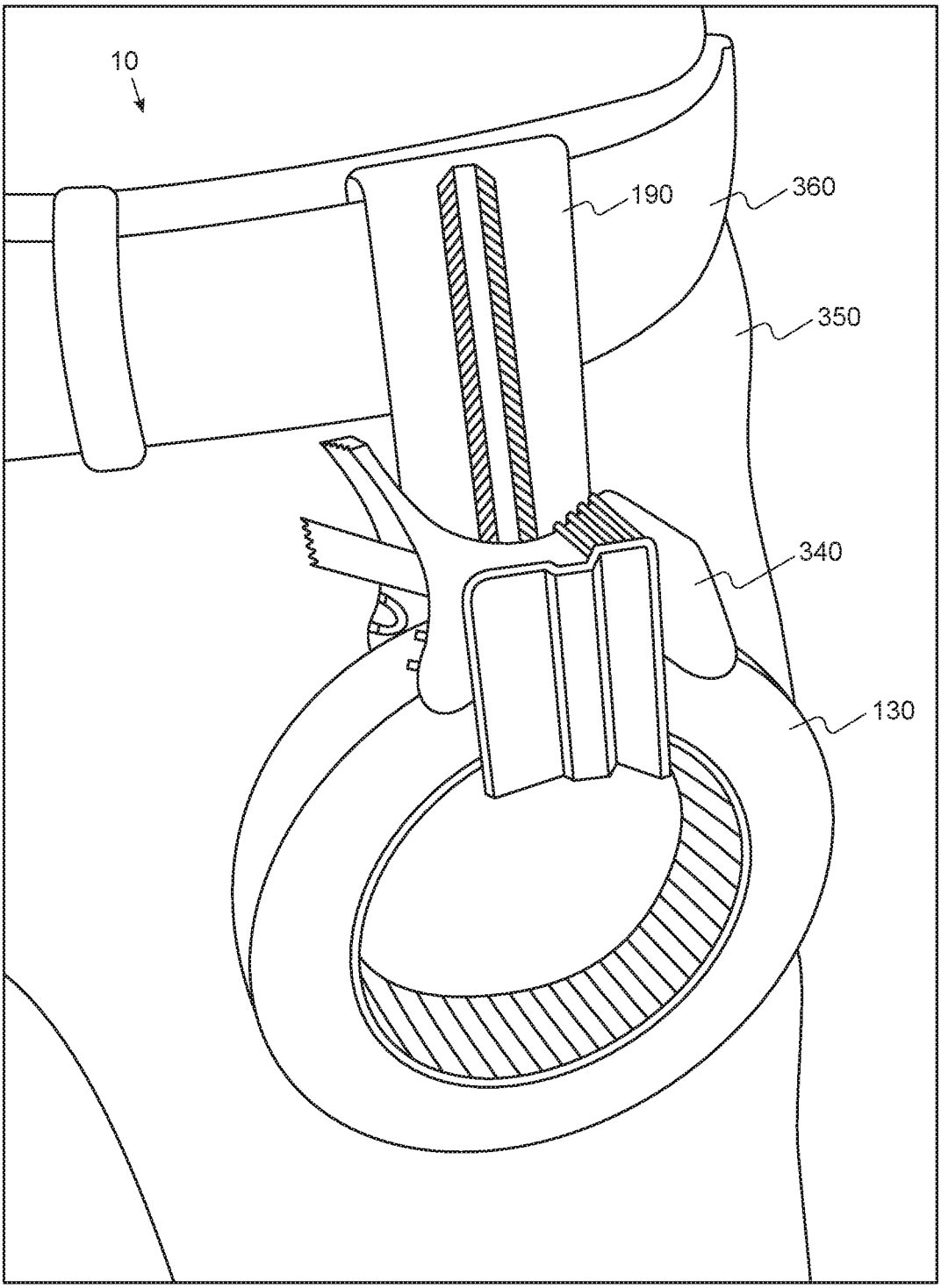
FIG. 15 is generally a side view illustration of a preferred embodiment in communication with a roll of tape and holster in accordance with the current invention.
Figure 16:
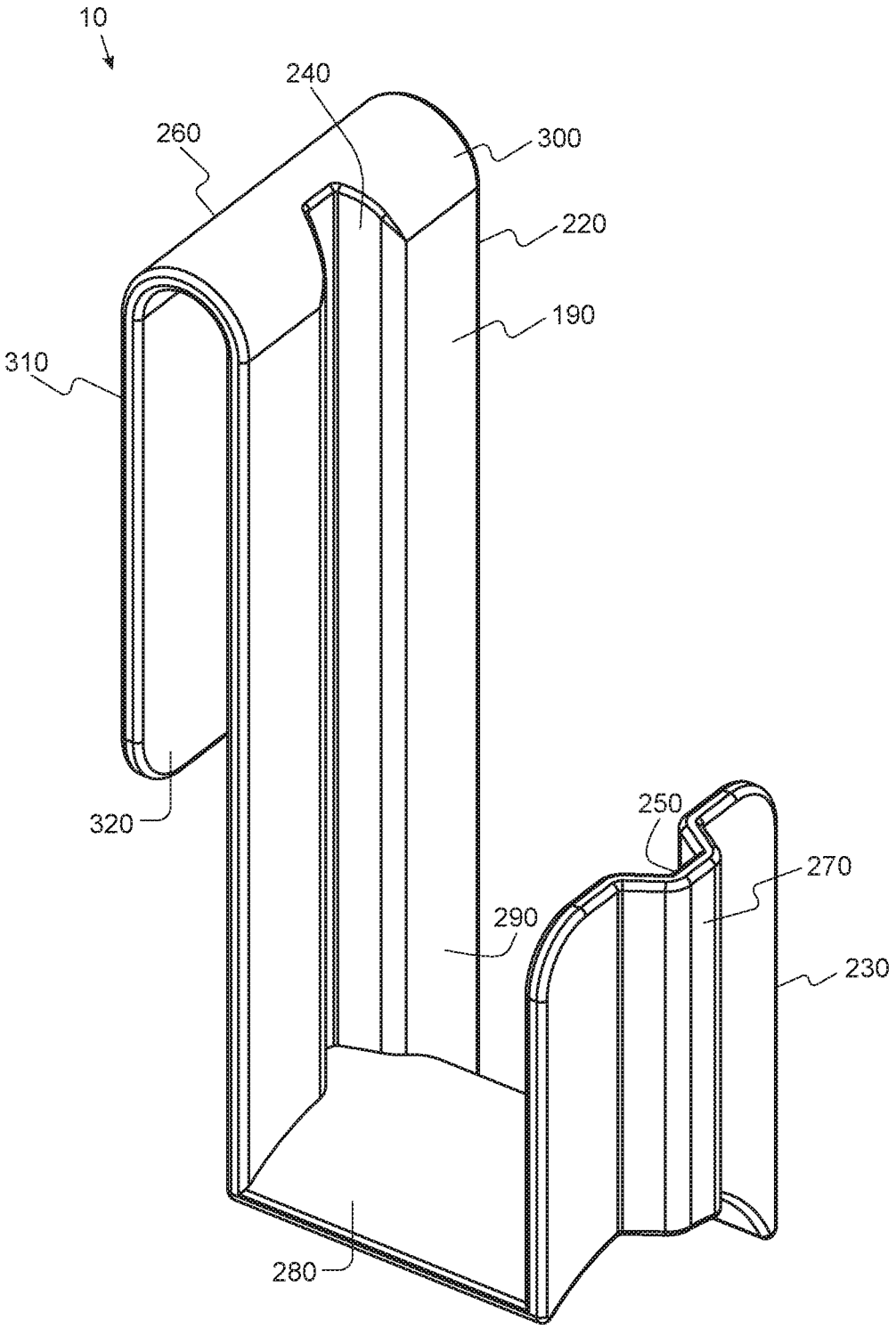
FIG. 16 is generally a perspective view illustration of a preferred embodiment of a holster in accordance with the current invention.
Figure 17:
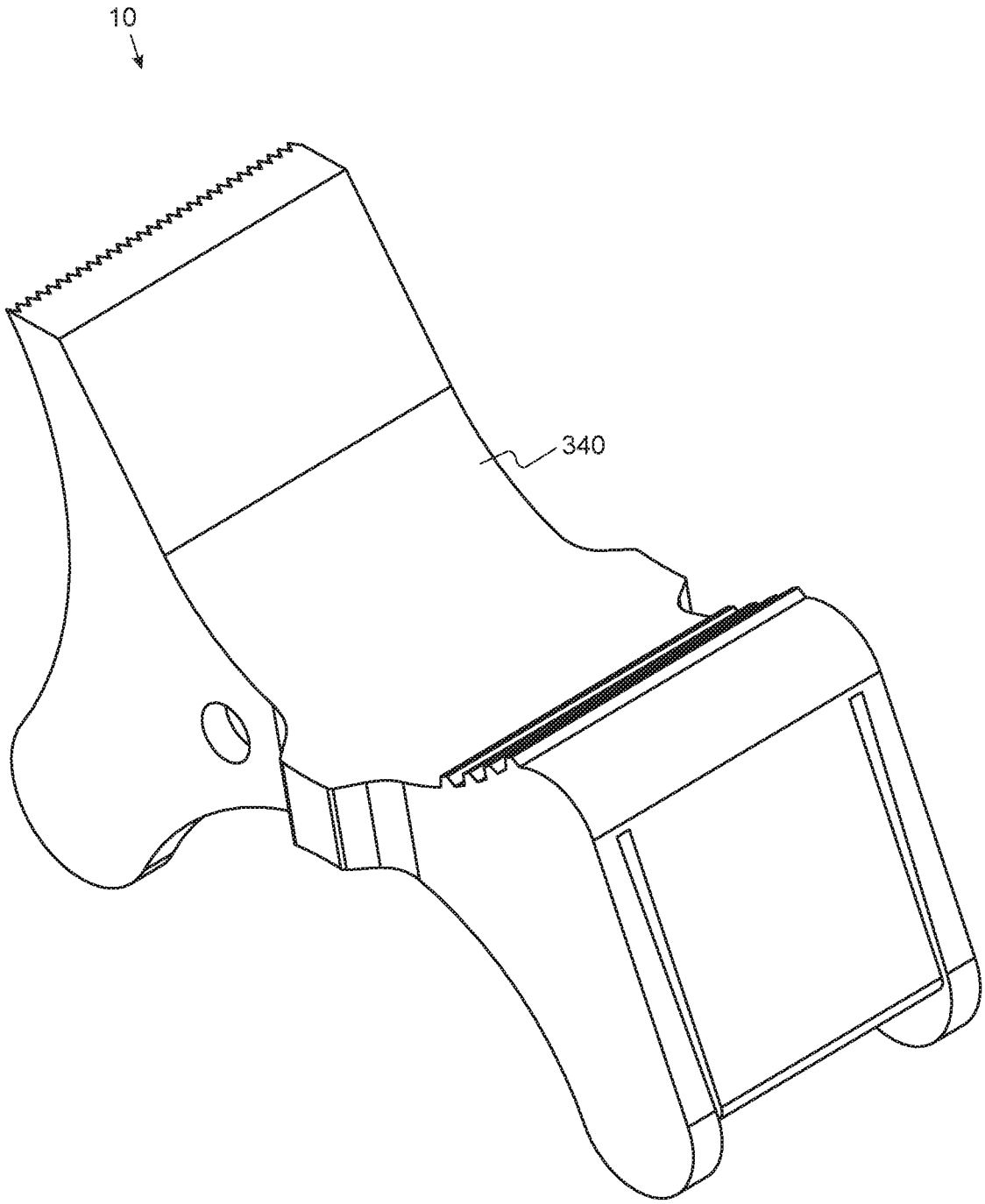
FIG. 17 is generally a perspective view illustration of a preferred embodiment of a tape dispensing apparatus in accordance with the current invention.
Figure 18:
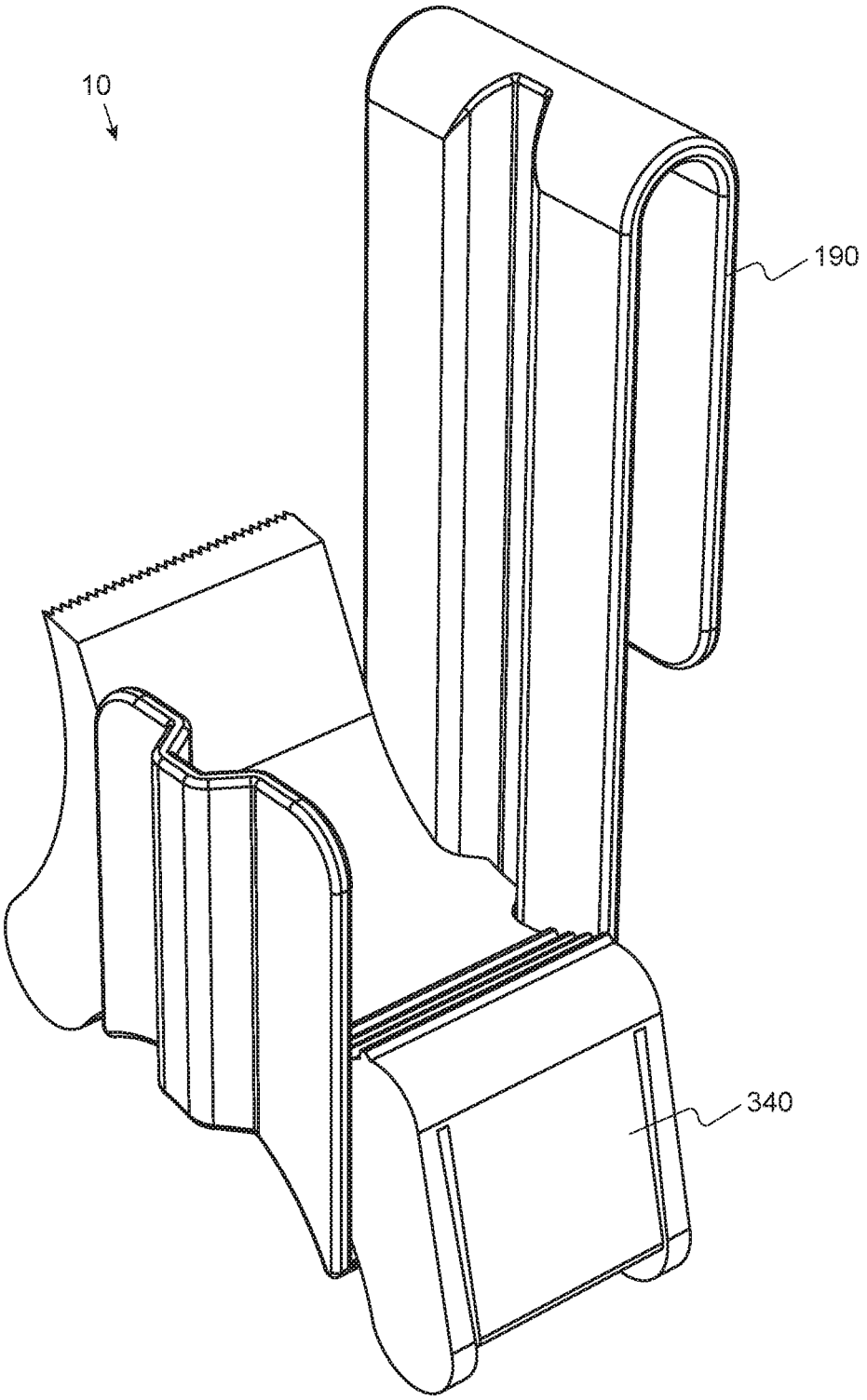
FIG. 18 is generally a perspective view illustration of a preferred embodiment with the dispenser apparatus removably attached to a holster in accordance with the current invention.
Figure 19:
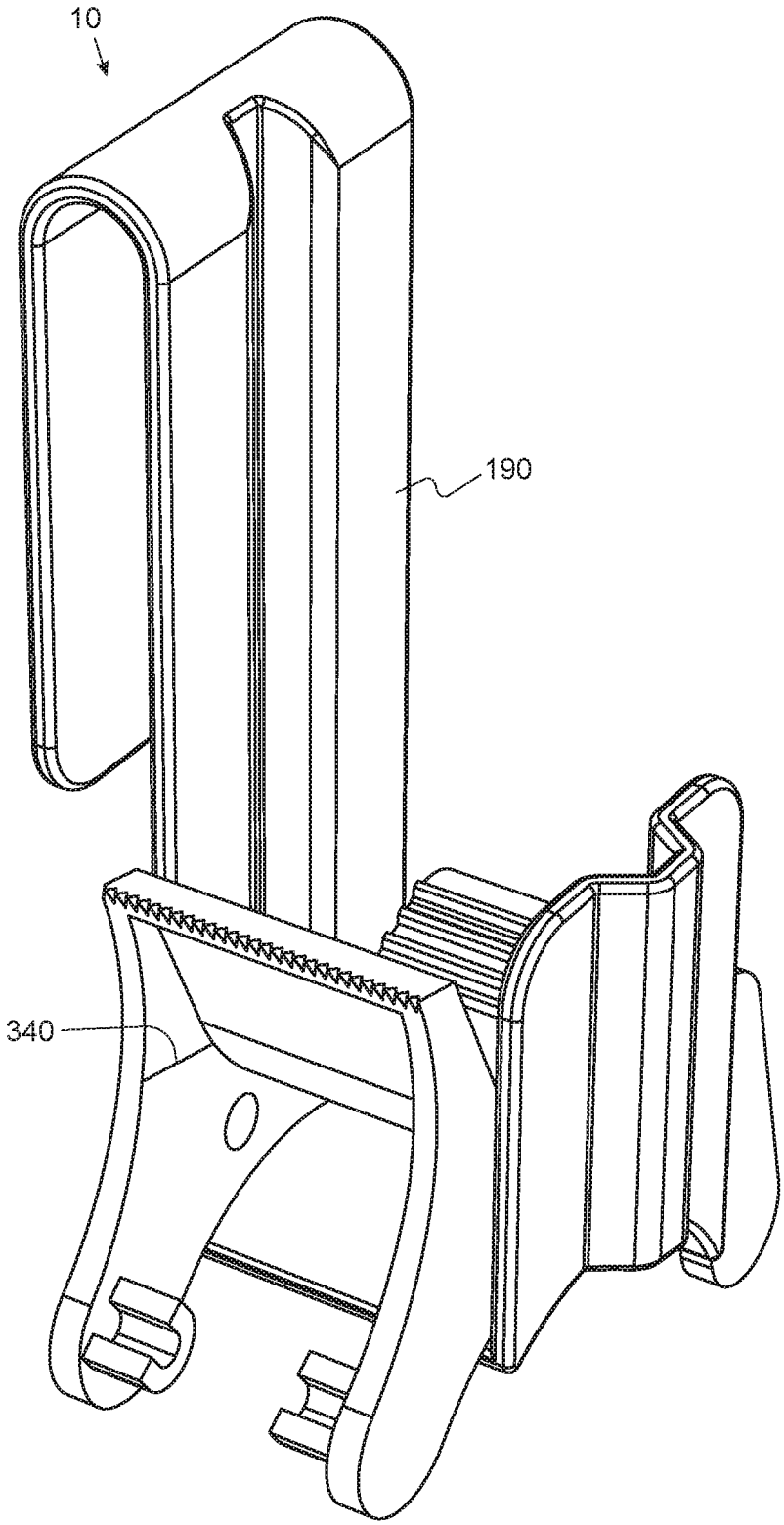
FIG. 19 is generally a perspective view illustration of a preferred embodiment with the dispenser apparatus removably attached to a holster in accordance with the current invention.

In a preferred construction, gripping end 30 may be of sloped, rounded or squared shape. The gripping end 30 abuts to the aperture 80. The aperture 80 may be enclosed by the left side 70 and right side 60 of the invention 10 or it may be left partially open as depicted in FIG. 3. Contained within the aperture 80, it is contemplated, but not intended to be limited to, that there is aperture contact surface 90. Aperture contact surface 90 communicates directly with the dispensed tape or material 130 when invention 10 is not being actively used. Aperture contact surface 90 may be a smooth or textured surface. Further, invention 10 and consequently the other portions of invention 10 including, but not limited to aperture 80, may be of numerous sizes and shapes and in order to accommodate tape rolls and spooled materials 130 of varying widths.

A non-enclosed tape dispensing apparatus may comprise, but is not intended to be limiting, a body having a top side, a bottom side, a right side, and a left side; said right side and said left side each having a tab to allow a user to grip said body; said top side having a gripping end, a cutting end and an aperture between said gripping end and said cutting end with said aperture being adapted to allow tape to pass through from said bottom side to said top side toward said cutting end; said cutting end being adjacent to said aperture on one end and the other end of said cutting end being sloped upward and extending beyond the top of said top side and having a cutting surface at the apex of said slope and said cutting surface is adapted to sever said tape passing through said aperture; said gripping end having a textured surface adapted to increase the user's grip of said gripping end while using said body; said bottom side being hollow so that said body can be placed on a spool of said tape and said right side and said left side will extend beyond the outermost circumference toward the center of said outermost circumference of said spool of said tape and said bottom side having a back and a front; said back of said bottom side adapted to contact said outermost circumference of said spool of said tape during use and said front of said bottom side having tape guides that are adapted to remain in constant contact with said outermost circumference of said spool of said tape during use in order to maintain a constant distance and angle of said cutting surface in relation to outermost circumference of said spool of said tape during use; said bottom side also having a roller that remains in contact with said spool of said tape as said tape passes through said body.

Invention 10 generally includes a holster 190 that may have a left wall 220, right wall 230, left wall groove 240, right wall groove 250, left wall ridge 260, right wall ridge 270, base 280, cavity 290, left wall bend 300, interior wall 310, and interior wall cavity 320. Roll of tape 130 may be used in conjunction with the invention 10. A tape dispensing apparatus 340 may be used in conjunction with the roll of tape 130 and the invention 10. The roll of tape 130 may hang from the base 280. The invention 10 may be clipped or hung from user 350 belt 360.

It is understood that roll of tape 130 is free to rotate while dispensing, but dispensing apparatus 340 is held firm by holster 190. This provides user 350 to use one hand 140 to dispense and cut without using a second hand to hold dispensing apparatus 340 from rotating.

A number of implementations have been described herein. Nevertheless, it will be understood that various modifications may be made. Accordingly, other implementations are within the scope of the following claims. Changes may be made in the combinations, operations, and arrangements of the various parts, elements, and amounts described herein without departing from the spirit and scope of the invention. From the foregoing description of the preferred embodiment of the invention, it will be apparent that many modifications can be made, and it will be understood that the presently disclosed embodiment is exemplary only, and that the invention is not limited thereto

What is claimed is:

1. A tape dispensing system comprising:

a holster adapted to be removably worn on a belt, and adapted to allow a spool of said tape to rotate for dispensing on said holster, a non-enclosed tape dispensing apparatus comprising:

a body having a top side, a bottom side, a right side, and a left side;

said right side and said left side each having a tab to allow a user to grip said body;

said top side having a gripping end, a cutting end and an aperture between said gripping end and said cutting end with said aperture being adapted to allow said tape to pass through from said bottom side to said top side toward said cutting end;

said cutting end being adjacent to said aperture on one end and the other end of said cutting end being sloped upward and extending beyond the top of said top side and having a cutting surface at the apex of said slope and said cutting surface is adapted to sever said tape passing through said aperture;

said gripping end having a textured surface adapted to increase the user's grip of said gripping end while using said body;

said bottom side being hollow so that said body can be placed on said spool of said tape and said right side and said left side will extend beyond the outermost circumference toward the center of said outermost circumference of said spool of said tape and said bottom side having a back and a front;

said back of said bottom side adapted to contact said outermost circumference of said spool of said tape during use and said front of said bottom side having tape guides that are adapted to remain in constant contact with said outermost circumference of said spool of said tape during use in order to maintain a constant distance and angle of said cutting surface in relation to outermost circumference of said spool of said tape during use; and said non-enclosed tape dispensing apparatus is adapted to be removably positioned in said holster for dispensing tape.

2. The tape dispensing system of claim 1 wherein said a non-enclosed tape dispensing apparatus said bottom side also having a roller that remains in contact with said spool of said tape as said tape passes through said body.

3. A non-enclosed tape dispensing apparatus comprising:

a body having a top side, a bottom side, a right side, and a left side;

said right side and said left side each having a tab to allow a user to grip said body;

said top side having a gripping end, a cutting end and an aperture between said gripping end and said cutting end with said aperture being adapted to allow tape to pass through from said bottom side to said top side toward said cutting end;

said cutting end being adjacent to said aperture on one end and the other end of said cutting end being sloped upward and extending beyond the top of said top side and having a cutting surface at the apex of said slope and said cutting surface is adapted to sever said tape passing through said aperture;

said gripping end having a textured surface adapted to increase the user's grip of said gripping end while using said body;

said bottom side being hollow so that said body can be placed on a spool of said tape and said right side and said left side will extend beyond the outermost circumference toward the center of said outermost circumference of said spool of said tape and said bottom side having a back and a front; and said back of said bottom side adapted to contact said outermost circumference of said spool of said tape during use and said front of said bottom side having tape guides that are adapted to remain in constant contact with said outermost circumference of said spool of said tape during use in order to maintain a constant distance and angle of said cutting surface in relation to outermost circumference of said spool of said tape during use.

* * * * *